US005121508A

United States Patent [19]

Grilliot et al.

[11] Patent Number: 5,121,508

[45] Date of Patent: Jun. 16, 1992

[54] FIREFIGHTER'S HELMET HAVING HEAD SECURING MEANS

[76] Inventors: William L. Grilliot; Mary I. Grilliot, both of 1986 Home Ave., Dayton, Ohio 45417; Abbott A. Lane, 1500 W. Third St., Dayton, Ohio 45407

[21] Appl. No.: 657,143

[22] Filed: Feb. 19, 1991

[51] Int. Cl.[5] ..... A42B 7/00

[52] U.S. Cl. ..... 2/421; 2/5

[58] Field of Search ..... 2/5, 416, 417, 418, 2/419, 420, 421

[56] References Cited

U.S. PATENT DOCUMENTS

| | | | |
|---|---|---|---|
| 2,802,212 | 8/1957 | Finken | 2/421 |
| 2,846,683 | 8/1958 | Dye et al. | 2/421 |
| 3,221,340 | 12/1965 | Joffe | 2/417 |
| 3,500,474 | 3/1970 | Austin | 2/418 |
| 3,714,668 | 2/1973 | Mirabella | 2/419 |
| 4,656,667 | 4/1987 | Blake | 2/5 |
| 4,766,609 | 8/1988 | Lane | 2/5 |
| 4,897,888 | 2/1990 | Broersma et al. | 2/421 |
| 4,903,348 | 2/1990 | Broersma | 2/421 |
| 4,932,076 | 6/1990 | Giorgio et al. | 2/5 |

FOREIGN PATENT DOCUMENTS

| | | | |
|---|---|---|---|
| 2213364 | 8/1989 | United Kingdom | 2/421 |

*Primary Examiner*—Werner H. Schroeder
*Assistant Examiner*—Michael A. Neas
*Attorney, Agent, or Firm*—William R. Jacox; Roger A. Gilcrest

[57] ABSTRACT

A firefighter's helmet having a rigid shell provided with a forward portion and a rearward portion and side portions. Attached to the rigid shell and extending downwardly therefrom are support members which are positioned at the rearward portion of the shell, and at the side portions of the shell. A flexible securing member is supported by the support members. After the helmet is positioned upon the head of a firefighter the flexible securing member is drawn firmly at the back and sides of the head of the firefighter. Also, portions of the flexible securing members are positioned under the chin of the firefighter and attached together. Thus, the helmet is secured upon the head of the firefighter, and the helmet cannot move with respect to the head of the firefighter who wears the helmet.

3 Claims, 4 Drawing Sheets

FIREFIGHTER'S HELMET HAVING HEAD SECURING MEANS

BACKGROUND OF THE INVENTION

A firefighter's helmet is a very important part of the firefighter's protective gear. During firefighting activity a helmet worn by a firefighter should be secure upon the head of the firefighter and should not move upon the head of the firefighter. Any movement of a helmet upon the head of a firefighter during firefighting activity may cause problems in the effectiveness of the firefighter's work.

A firefighter's helmet conventionally includes a face protective shield. The face protective shield is pivotally attached to the helmet and is pivotally movable upwardly and downwardly at the forward portion of the helmet. Therefore, a conventional helmet of a firefighter is heavier at the front portion thereof than at the rearward portion thereof.

Conventionally, a firefighter's helmet includes only a chinstrap to retain the helmet upon the head of the firefighter. However, due to the fact that the firefighter's helmet is heavier at the forward portion thereof, the helmet tends to tip forwardly upon the firefighter's head. Of course, such forward tipping is objectionable, and a conventional chinstrap does not assist in preventing the forward tipping.

It is therefore an object of this invention to provide a firefighter's helmet which can be securely attached to the head of a firefighter and which does not move with respect to the firefighter's head.

It is another object of this invention to provide such a firefighter's helmet which can be easily, readily, and quickly attached to the head of a firefighter.

Another object of this invention is to provide a firefighter's helmet which includes securing means for securing the helmet to the rear portion, and to the side portions and to the front portion of the head of the firefighter who wears the helmet.

Another object of this invention is to provide such a firefighter's helmet in which the securing means can be operated easily and readily and quickly by the firefighter who wears the helmet.

Another object of this invention is to provide such a firefighter's helmet which can be constructed at substantially the same costs as a conventional helmet for a firefighter.

Other objects and advantages of this invention reside in the construction of the firefighter's helmet, the method of production and the mode of use, as will become more apparent from the following description.

SUMMARY OF THE INVENTION

A firefighter's helmet of this invention comprises a rigid shell. Within the rigid shell, at the upper portion thereof, is an impact pad. Attached to the impact pad and extending downwardly therefrom is a plurality of straps. The lower ends of the straps are attached to a head band which encompasses the head of the firefighter. Attached to the head band and extending downwardly therefrom is a flexible heat shield which covers the back of the neck and sides of the head of the firefighter who wears the helmet.

Supported by the rigid shell is helmet securing means. The helmet securing means is positioned at various positions with respect to the rigid shell. Thus, the helmet securing means is positioned at various positions with respect to the firefighter's head, including the rear portion of the firefighter's head and at the sides of the firefighter's head and under the chin of the firefighter who wears the firefighter's helmet.

The securing means includes adjustment means for adjustment of the securing means upon the head of the firefighter. Preferably, the securing means includes means for maintaining the adjusted position of the securing means upon the head of a firefighter. Thus, the firefighter's helmet can be easily and readily and quickly secured upon the head of the firefighter. The securing means also includes attachment means for attaching the securing means upon the head of the firefighter who wears the firefighter's helmet. Thus, the firefighter's helmet is secured upon the head of the firefighter. When the firefighter's helmet is secured upon the head of a firefighter the firefighter's helmet is retained against movement with respect to the firefighter's head.

DETAILED DESCRIPTION OF THE PREFERRED EMBODIMENT

Figure 1:
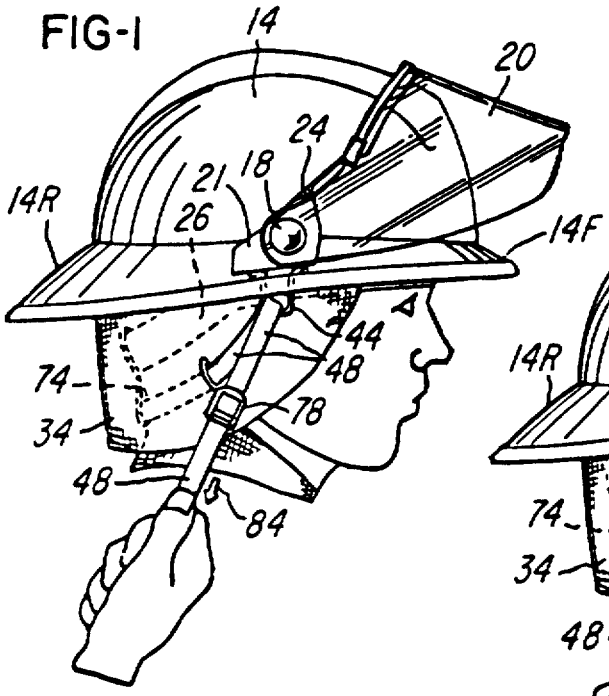
FIG. 1 is a right side view of a firefighter's helmet of this invention, showing the helmet upon the head of a firefighter and illustrating a step in the operation of the securing means of the helmet. This view shows the right side of the helmet and the right side of the head of the firefighter.

A firefighter's helmet of this invention comprises an outer shell 14 of rigid material which is, inter alia, abrasion resistant and shock resistant. The outer shell 14 has a forward or front portion 14F and a rearward or back portion 14R. Pivotally attached to the side portions of the shell 14 by means of pins 18 is a face shield 20. The pins 18 are attached to brackets 21 which are attached to the exterior portion of the shell 14 at opposite sides thereof and adjacent the periphery thereof. Bolt members 22 and nuts 23 attach the brackets 21 to the shell 14. Spring members 24 are shown attached to the face shield 20 and to the brackets 21. The spring members 24 assist in maintaining the face shield 20 in any pivotal adjusted position thereof.

Figure 9:
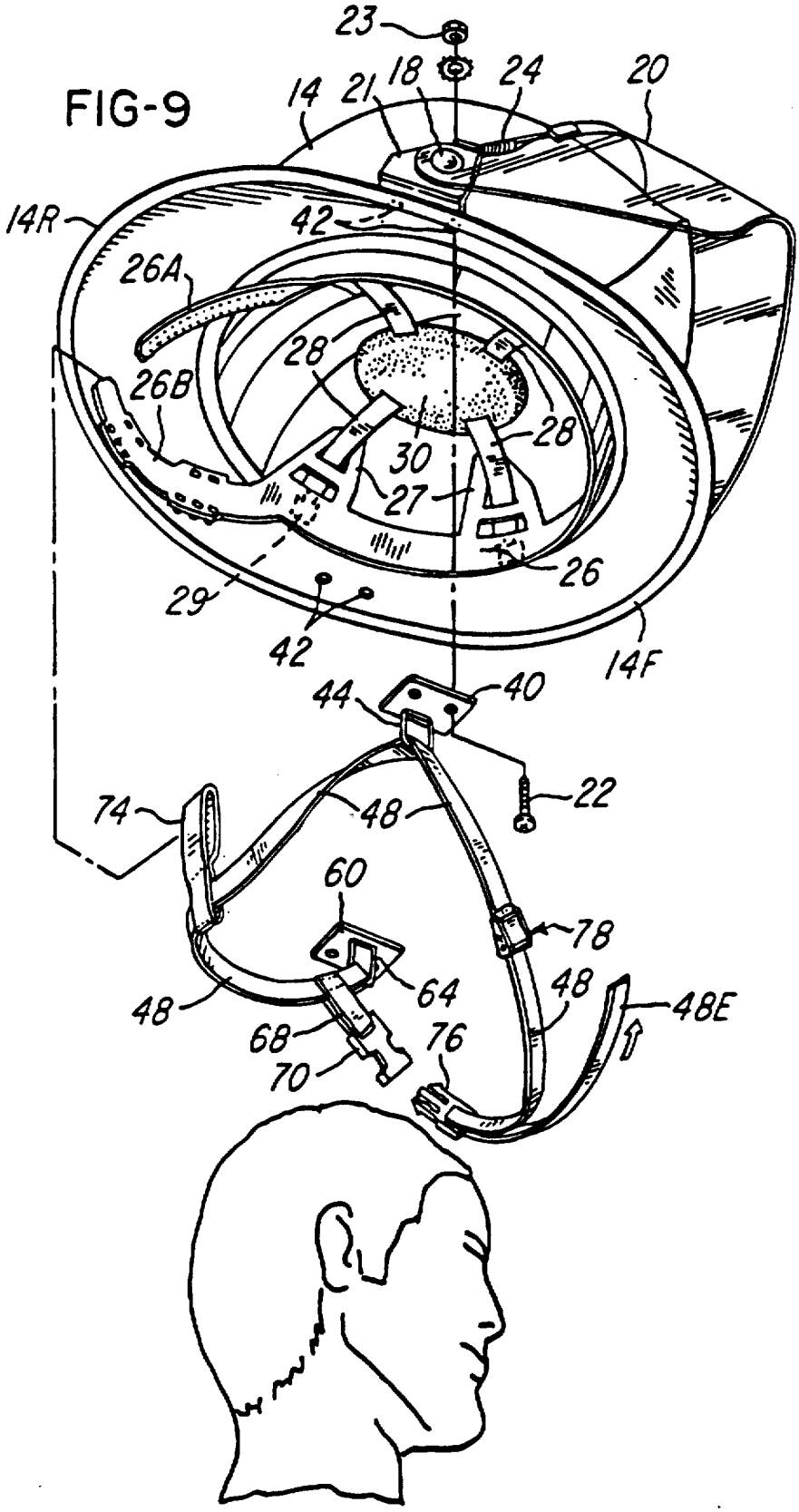
FIG. 9 is a perspective exploded view, drawn on substantially the same scale as FIGS. 1-5, showing the internal portions of the firefighter's helmet of this invention and illustrating positioning of the helmet upon the head of the firefighter. In this view the heat shield is omitted to simplify the disclosure.
Figure 10:
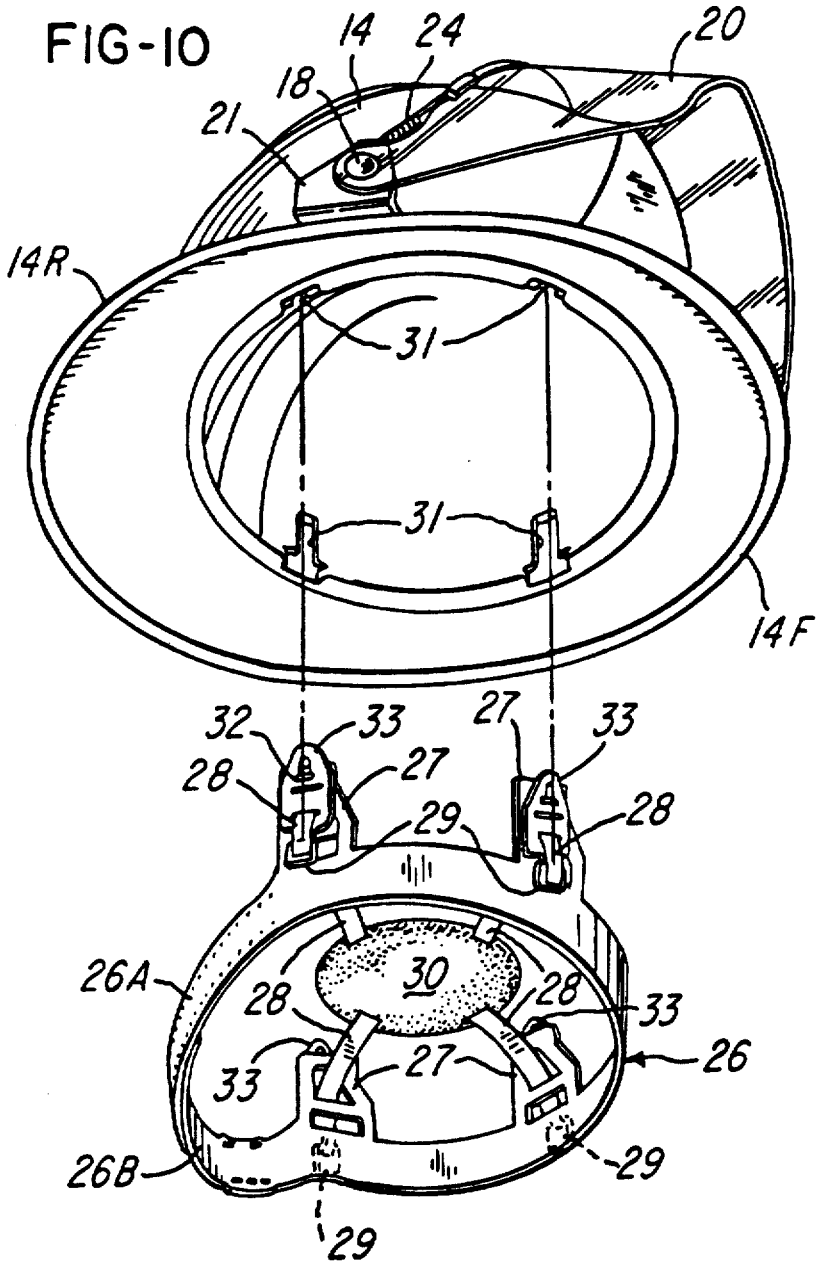
FIG. 10 is an exploded perspective view showing further details of the internal portions of the firefighter's helmet.
Figure 11:
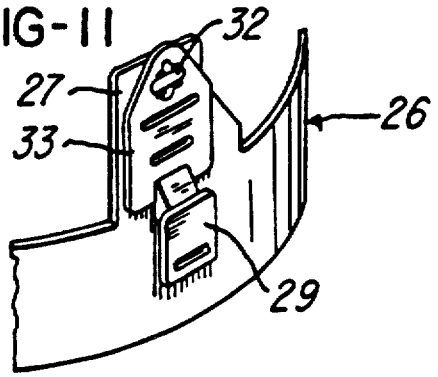
FIG. 11 is an enlarged fragmentary perspective view of a portion of the structure shown in FIG. 10. However, for purposes of clarity, a strap member is not shown in this view.

Within the shell 14 is a head band 26. The head band 26 has upwardly extending tabs 27. Extending upwardly through the tabs 27 of the head band 26 are strap members 28 which are attached to the internal portions of the shell 14, adjacent the head band 26, by any suitable means, such as by block-like clip members 29. Integral with each block-like clip member 29 is a leaf member 33. Each of the strap members 28 is attached to one of the leaf members 33 and to its respective block-like clip member 29. Each of the block-like clip members 29 is attached by means of a joiner member 32 to one of the tabs 27 of the head band 26. The clip members 29 are slidably and resilently positioned within slots 31 which are within the internal portions of the shell 14. Thus, the head band 26 is attached to the shell 14. Attached to the upper portions of the strap members 28 is a pad 30, which is spaced from the internal upper surface of the shell 14. At the rear portion 14R of the shell 14 the head band 26 has attachment portions 26A and 26B which are adjustably attachable together, as the portion 26A has a plurality of apertures which receive connection pins which are carried by the portion 26B, as best shown in FIG. 9.

Attached by any suitable means, not shown, to the internal portions of the shell 14 adjacent the head band 26 is a flexible heat shield 34, which extends downwardly from the shell 14, and is adapted to cover the rear neck portion and side portions of the head of the firefighter who wears the helmet.

On the right side portion of the shell 14 on the under surface thereof and adjacent the periphery thereof is an attachment plate 40, which is secured to the shell 14 by means of the bolt members 22, which extend through holes 42 in the peripheral portion of the shell 14 and also attach the bracket 21 to the shell 14 at the right exterior side thereof.

Figure 6:
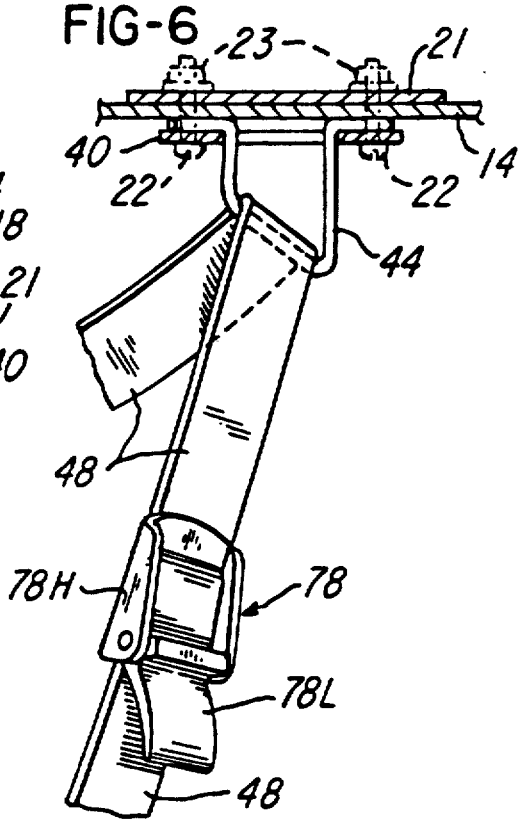
FIG. 6 is an enlarged fragmentary sectional view. This view shows in perspective an adjustment portion of the securing means in an initial position thereof.

As best shown in FIG. 6, the plate 40 joins a U-shape attachment member 44 to the shell 14. The U-shape attachment member 44 extends slightly downwardly from the lower surface of the shell 14. Extending through the attachment member 44 is a strap member 48.

On the left side portion of the shell 14 on the under surface thereof and adjacent the periphery thereof is an attachment plate 60, which is joined to the shell 14 by means of the bolt members 22, which extend through holes 42 in the periphery of the shell 14 and also attach the bracket 21 to the shell 14 at the left exterior side thereof.

The attachment plate 60 at the left side portion of the shell 14 attaches a U-shape attachment member 64 to the shell 14. The U-shape attachment member 64 extends slightly downwardly from the lower surface of the shell 14. The strap member 48 has an end portion attached to the U-shape attachment member 64.

Attached to the strap member 48, adjacent the U-shape attachment member 64, is a short strap 68. The short strap 68 has portions thereof attached together and to the strap member 48 by stitching or the like to retain the short strap 68 upon the strap member 48. Attached to the short strap 68 is a connection member 70.

Encompassing the rear portion of the head band 26, adjacent the attachment portions 26A and 26B, is a short support strap 74 which extends downwardly from the head band 26. The strap member 48 extends freely through the short support strap 74.

The strap member 48 extends from the U-shape attachment member 44 at the right side of the shell 14. Spaced from the attachment member 44, the strap member 48 has an end portion 48E. Between the end portion 48E and the U-shape attachment member 44 is a connection member 76 which is adjustably positioned upon the strap member 48. The connection member 76 is complementary to the connection member 70 and is connectable thereto.

Between the connection member 76 and the U-shape attachment member 44 and adjustably mounted upon the strap member 48 is an abutment clamp 78.

Operation

When a firefighter dons the helmet of this invention, the shell 14 is placed upon the head of the firefighter with the heat shield 34 covering the rear neck portion and sides of the head of the firefighter. The head band 26 encompasses the head of the firefighter, with the pad 30 and straps 28 engaging the head of the firefighter.

As shown and as stated above, the rear part of the head band 26 has adjustment portions 26A and 26B. Therefore, the head band 26 can be adjusted to properly fit around the head of the firefighter. The short support strap 74 and a part of the strap member 48 are adjacent the lower rear portion of the head of the firefighter when the firefighter dons the helmet.

After the shell 14 of the firefighter's helmet is positioned upon the head of the firefighter, the firefighter grasps the strap 48, as shown in FIG. 1, and pulls upon the strap 48, as illustrated by an arrow 84. When this occurs, the strap 48 slidably moves through the short support strap 74 and through the U-shape attachment member 44. In this manner, the strap member 48 is drawn snugly at the lower rear portion of the head of the firefighter and at the side portions of the head of the firefighter.

The abutment clamp 78 includes a housing 78H and a pivotal lever 78L. When the lever 78L is in the pivotal position thereof shown in FIGS. 6 and 7 the housing 78H of the abutment clamp 78 can be slidably moved along the strap member 48. As the strap member 48 is maintained snugly adjacent the rear portion and side portions of the head of the firefighter, the abutment clamp 78 is slidably moved along the strap member 48. With the pivotal lever 78L in the pivotal position thereof shown in FIGS. 6 and 7, the abutment clamp 78 is slidably moved upwardly upon the strap member 48, as illustrated by an arrow 86 in FIG. 7. The abutment clamp 78 is slidably moved upon the strap member 48 from the position of the abutment clamp 78 shown in FIG. 6 to the position of the abutment clamp 78 shown in FIG. 7.

Figure 2:
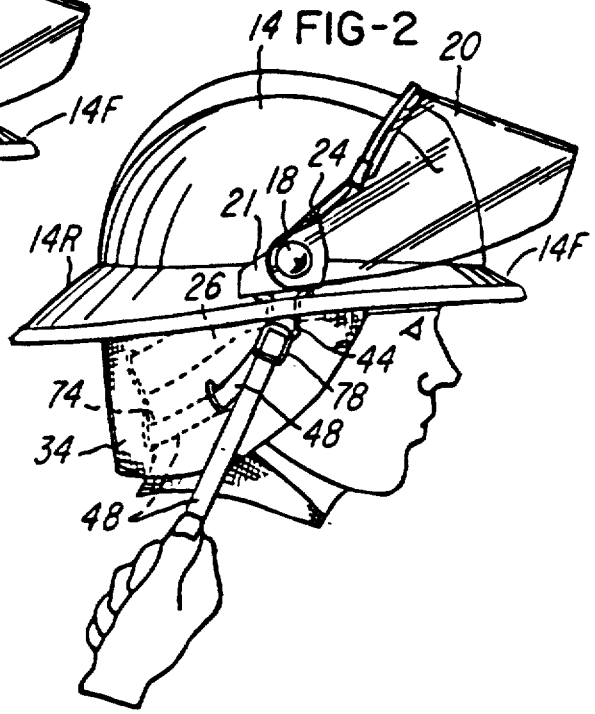
FIG. 2 is a right side view, similar to FIG. 1, showing the right side of the firefighter's helmet of this invention and the right side of the head of the firefighter. This view illustrates a further step in the operation of the securing means of the firefighter's helmet.
Figure 7:
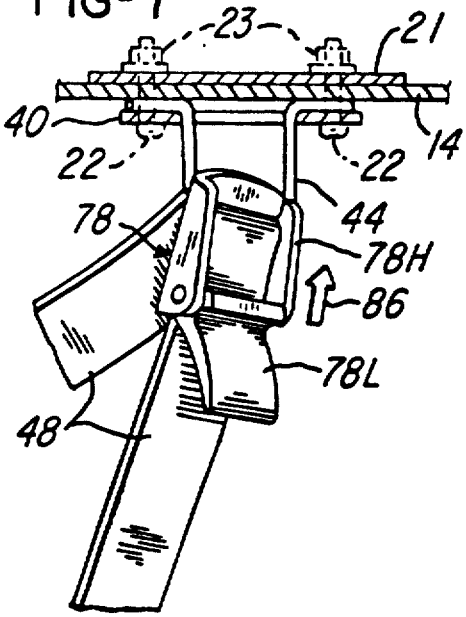
FIG. 7 is an enlarged fragmentary sectional view, similar to FIG. 6. This view shows in perspective the adjustment portion of the securing means in another position of the operation thereof.
Figure 8:
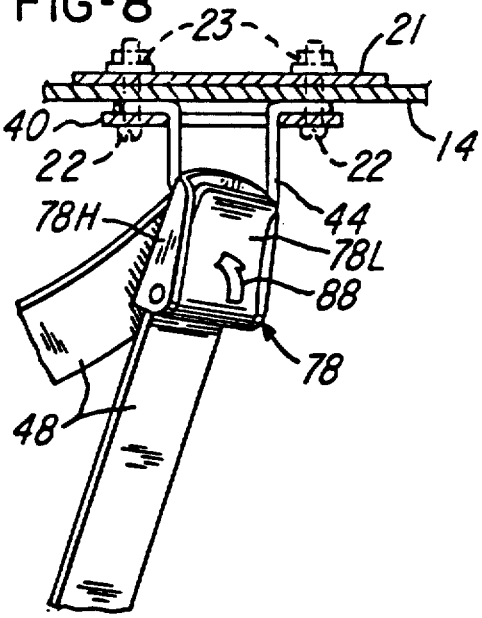
FIG. 8 is an enlarged fragmentary sectional view, similar to FIGS. 6 and 7. This view shows in perspective the adjustment portion of the securing means in another position of the operation thereof.

When the abutment clamp 78 is positioned as shown in FIG. 7, the abutment clamp 78 is in firm engagement with the U-shape attachment member 44. Then, with the strap member 48 drawn and maintained snugly at the rear portion and side portions of the head of the firefighter, the lever 78L is pivotally moved, as illustrated by an arrow 88, to the position thereof shown in FIG. 8. When the lever 78L is pivotally moved to the position thereof shown in FIG. 8 the abutment clamp 78 is clamped upon the strap member 48 and against the U-shape attachment member 44, as shown in FIGS. 2 and 8. Thus, the strap member 48 is maintained in a taut condition at the lower rear portion and side portions of the firefighter's head.

Thus, the strap member 48 firmly secures the shell 14 to the lower rear portion of the head of the firefighter and to the side portions of the head of the firefighter.

Figure 4:
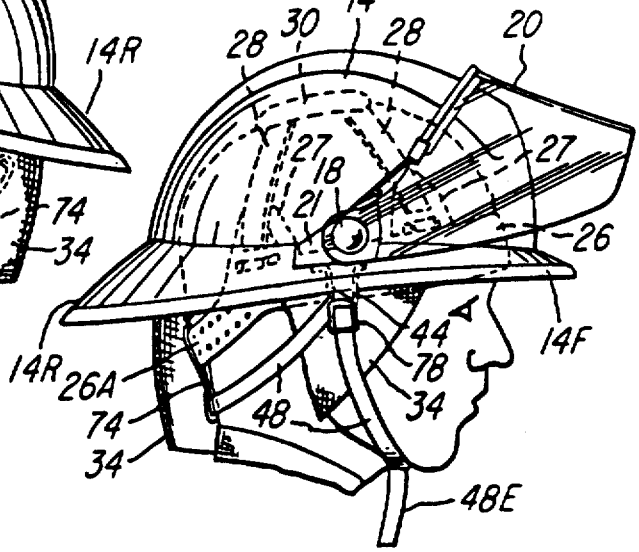
FIG. 4 is right side view of the firefighter's helmet of this invention, with parts broken away and shown in section, and illustrating the firefighter's helmet following the securing thereof upon the head of the firefighter.
Figure 5:
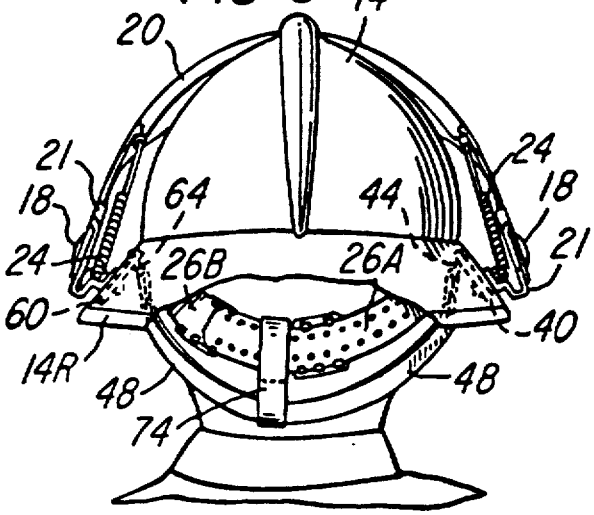
FIG. 5 is a back view of the firefighter's helmet, with parts broken away and shown in section, as the firefighter's helmet of this invention is secured upon the head of the firefighter.

Then the part of the strap member 48 which is adjacent the end portion 48E is positioned under the chin of the firefighter. Then the connection member 76 is attached to the connection member 70. Thus, the strap member 48 also serves as a chin strap under the chin of the firefighter, as illustrated in FIG. 4.

Figure 3:
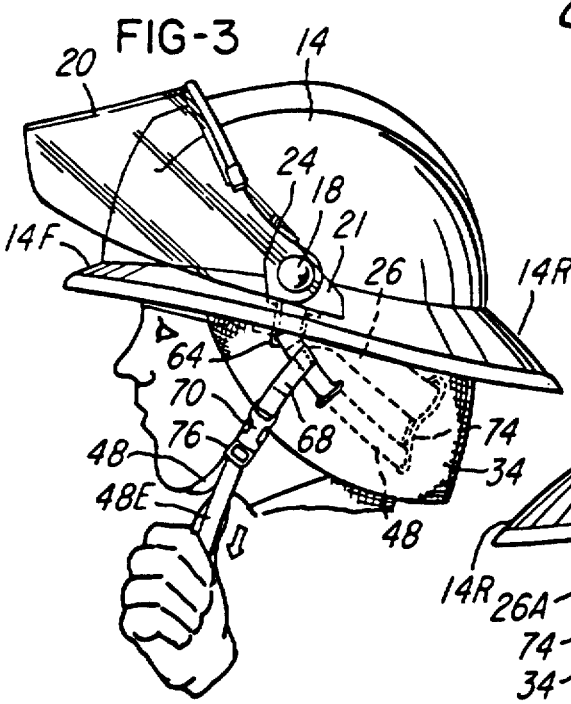
FIG. 3 is a left side view of the firefighter's helmet of this invention, illustrating a further step in the operation of the securing means of the firefighter's helmet.

After the connection members 70 and 76 are attached together, the firefighter grasps the end portion 48E of the strap member 48 and pulls upon the strap member 48, as illustrated in FIG. 3. As the end portion 48E of the strap member 48 is pulled, the strap member 48 slides within the connection member 76. Thus, the strap member 48 is drawn snugly under the chin of the firefighter.

Thus, the strap member 48 serves to retain the shell 14 firmly upon the head of the firefighter, as the strap member 48 is positioned snugly at the rear portion of the head of the firefighter and at the side portions of the head of the firefighter and under the chin portion of the firefighter.

Due to the fact that portions of the strap member 48 are positioned snugly at the lower rear portion of the head and at the sides of the head of the firefighter, the rear portion and side portions of the shell 14 are secured to the lower rear portion and to the side portions of the head of the firefighter. The shell 14 is also secured to the front part of the firefighter's head as the strap member 48 extends under the chin of the firefighter. Therefore, the firefighter's helmet of this invention is secured upon the head of the firefighter, and the firefighter's helmet cannot move with respect to the head of the firefighter.

As stated and as illustrated, one step in donning of the firefighter's helmet of this invention is that of sliding the abutment clamp 78 upon the strap member 48 into engagement with the U-shape attachment member 44, with the strap member 48 taut at rear portion and side portions of the head of the firefighter. Then the abutment clamp 78 is clamped upon the strap member 48 and in engagement with the U-shape abutment member 44. This step firmly attaches the shell 14 to the rear portion and side portions of the head of the firefighter, prior to operation of the chinstrap portion of the strap member 48.

Then the portion of the strap member 48 which serves as a chinstrap is secured under the chin of the firefighter and drawn snugly under the chin of the firefighter.

This step which employs the abutment clamp 78 is desirable, but, under certain circumstances, may be omitted. When the abutment clamp operation is omitted, the strap member 48 is drawn snugly at the rear portion and side portions of the head and under the chin of the firefighter in a single operation.

Although the preferred embodiment of the firefighter's helmet of this invention has been described, it will be understood that within the purview of this invention various changes may be made in the form, details, proportion and arrangement of parts, the combination thereof, method of construction and the mode of use, which generally stated consist in a firefighter's helmet within the scope of the appended claims.

The invention having thus been described, the following is claimed:

1. A firefighter's helmet for the head of a firefighter, comprising a rigid shell positionable upon the head of a firefighter, the rigid shell having a forward portion and a rearward portion, the rigid shell being positionable upon the head of the firefighter with the forward portion of the rigid shell at the forward portion of the head of the firefighter, the rigid shell also having opposed side portions, securing means including a rear section at the rearward portion of the rigid shell, connection means, the connection means including first support means, the first support means joining the rear section of the securing means to the rigid shell, whereby the rear section of the securing means is positioned adjacent the back region of the head of the firefighter who wears the firefighter's helmet, the securing means also including side sections adjacent the side portions of the rigid shell, the connection means also including second support means, the second support means joining the side sections of the securing means to the side portions of the rigid shell whereby the side sections of the securing means are positioned adjacent the side regions of the head of the firefighter upon whose head the rigid shell is positioned, and means for adjustably positioning the securing means in firm positions with respect to the back region and side regions of the head of the firefighter upon whose head the rigid shell is positioned, and in which the securing means includes a portion which is movable with respect to the connection means for adjusting the position of said portion of the securing means with respect to the side regions and back region of the head of the firefighter upon whose head the shell is positioned, the firefighter's helmet including an abutment clamp member supported by the securing means, the abutment clamp member being movable upon said portion of the securing means and into engagement with the connection means, the abutment clamp member including means for clampingly positioning the abutment clamp member upon said portion of the securing means and in engagement with the connection means, whereby the position of said portion of the securing means with respect to the connection means and with respect to the side regions and back region of the head of the firefighter upon whose head the shell is positioned is firmly maintained, whereby the rigid shell of the firefighter's helmet is secured to a plurality of regions of the head of the firefighter who wears the firefighter's helmet and upon whose head the rigid shell is positioned, whereby the rigid shell of the helmet is prevent from movement with respect to the head of the firefighter who wears the helmet.

2. A firefighter's helmet for the head of a firefighter comprising a rigid shell positionable upon the head of the firefighter, the rigid shell having a forward portion and a rearward portion, the rigid shell also having a right side portion and a left side portion, the rigid shell being positionable upon the head of the firefighter with the forward portion of the rigid shell adjacent the forward portion of the head of the firefighter, flexible elongate securing means, the flexible elongate securing means having a rearward portion adjacent the rearward portion of the shell, the securing means having side portions adjacent the side portions of the rigid shell, the securing means having forward portions extending from the side portions of the rigid shell, first attachment means, the first attachment means joining the securing means to the right side of the rigid shell, second attachment means, the second attachment means joining the securing means to the left side portion of the rigid shell, third attachment means, the third attachment means joining the securing means to the rigid shell, whereby portions of the securing means are positioned adjacent the rear portion of the head of a firefighter upon whose head the rigid shell is positioned, whereby portions of the securing means are positioned adjacent the side portions of the head of the firefighter upon whose head the rigid shell is positioned, and whereby the forward portions of the head of the firefighter upon whose head the rigid shell is positioned, said securing means having a movable portion which is adjustable with respect to the attachment means for urging the securing means toward the side portions and rear portion of the head of the firefighter who wears the helmet and upon whose head the shell is positioned, the helmet including an abutment clamp which is attached to the securing means and movable with respect thereto, the abutment clamp being movable with respect to the securing means and into engagement with the attachment means, the abutment clamp being clampingly attachable to the securing means, whereby the abutment clamp is clampingly attachable to the securing means and in engagement with the attachment means for retaining the movable portion of the securing means in desired adjusted position with respect to the side portions and rear portion of the head of the firefighter, and releasable locking means attaching together forward portions of the securing means, whereby the rigid shell of the helmet is secured upon the head of the firefighter upon whose head the shell is positioned and the rigid shell is prevented from movement with respect to the head of the firefighter upon whose head the rigid shell is positioned.

3. The method of construction of a firefighter's helmet for the head of a firefighter comprising providing a rigid shell having a forward portion and a rearward portion and a pair of opposed side portions, providing securing means, designating parts of the securing means as side parts of the securing means, designating a part of the securing means as a forward part of the securing means, attaching the rearward part of the securing means to the rigid shell, attaching the side parts of the securing means to the side portions of the rigid shell, in which attaching the side parts and rearward part of the securing means to the shell includes providing connection members through which the side parts and the rearward part of the securing means slidably extend, whereby the securing means is adjustable with respect to the sides and back part of the head of the firefighter upon whose head the rigid shell is positioned, extending the forward part of the securing means from the side portions of the rigid shell, the rigid shell being positionable upon the head of a firefighter with the forward portion of the shell adjacent the forward portion of the head of the firefighter, whereby the rearward part of the securing means is positioned adjacent the back part of the head of the firefighter as the rigid shell is positioned upon the head of a firefighter, and whereby the side parts of the securing means are positioned adjacent the sides of the head of the firefighter as the rigid shell is positioned upon the head of the firefighter, and whereby the forward part of the securing mans is positioned adjacent the forward portion of the head of the firefighter as the rigid shell is positioned upon the head of the firefighter, whereby the rigid shell is secured upon the head of the firefighter upon whose head the rigid shell is positioned, and whereby the firefighter's helmet is secured upon the head of the firefighter who wears the firefighter's helmet.

* * * * *

UNITED STATES PATENT AND TRADEMARK OFFICE

CERTIFICATE OF CORRECTION

PATENT NO. : 5,121,508

DATED : June 16, 1992

INVENTOR(S) : William L. Grilliot, et. al.

It is certified that error appears in the above-indentified patent and that said Letters Patent is hereby corrected as shown below:

Column 7, line 25, after the word "portions' add the words "of the securing means are positionable adjacent the forward portion--".

Signed and Sealed this

Twelfth Day of October, 1993

*Attest:*

*Attesting Officer*

Bruce Lehman

BRUCE LEHMAN

*Commissioner of Patents and Trademarks*